US011404809B2

(12) United States Patent
Oosaka

(10) Patent No.: US 11,404,809 B2
(45) Date of Patent: Aug. 2, 2022

(54) ELECTRICAL CONNECTOR ASSEMBLY WITH SHIELDING SHELLS SURROUNDING EACH OF FIRST AND SECOND CONNECTORS

(71) Applicant: JAPAN AVIATION ELECTRONICS INDUSTRY, LIMITED, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/218,268

(22) Filed: Mar. 31, 2021

(65) Prior Publication Data

US 2021/0359440 A1 Nov. 18, 2021

(30) Foreign Application Priority Data

| | | |
|---|---|---|
| May 13, 2020 | (JP) | JP2020-084468 |
| May 26, 2020 | (JP) | JP2020-091146 |
| Jun. 12, 2020 | (JP) | JP2020-102280 |
| Jun. 18, 2020 | (JP) | JP2020-105098 |
| Jul. 14, 2020 | (JP) | JP2020-120397 |

(51) Int. Cl.
*H01R 12/71* (2011.01)
*H01R 12/57* (2011.01)
(Continued)

(52) U.S. Cl.
CPC ..... *H01R 12/716* (2013.01); *H01R 12/57* (2013.01); *H01R 12/73* (2013.01); *H01R 13/6582* (2013.01); *H01R 13/6591* (2013.01); *H01R 13/6594* (2013.01); *H01R 12/51* (2013.01); *H01R 12/52* (2013.01); *H01R 12/712* (2013.01);
(Continued)

(58) Field of Classification Search
CPC ..... H01R 12/716; H01R 12/57; H01R 12/73; H01R 13/6585; H01R 13/6591; H01R 13/6594; H01R 12/51; H01R 12/52; H01R 12/712; H01R 13/658; H01R 13/6581; H01R 13/71; H01R 13/20
See application file for complete search history.

(56) References Cited

U.S. PATENT DOCUMENTS

2017/0033510 A1* 2/2017 Ozeki ..... H01R 43/205

FOREIGN PATENT DOCUMENTS

JP 2017-033654 A 2/2017

* cited by examiner

*Primary Examiner* — Abdullah A Riyami
*Assistant Examiner* — Justin M Kratt
(74) *Attorney, Agent, or Firm* — Greenblum & Bernstein, P.L.C.

(57) ABSTRACT

In a connector assembly in which a first connector and a second connector are fitted to each other, a first shell, which has a rectangular frame-like shape and serves as an outer shell of the first connector, includes curved portions on upper ends of respective sides of the rectangle, and a second shell, which has a rectangular frame-like shape and serves as an outer shell of the second connector, includes convex portions, which are elongated along respective sides to be slender, on outer surfaces on the sides of the rectangle. The curved portions and the convex portions are positioned so that the curved portions and the convex portions are partially overlapped with each other. The convex portions are in contact with the first shell through the entire lengths, and the curved portions are in contact with the second shell through the entire lengths.

15 Claims, 15 Drawing Sheets

(51) Int. Cl.

| | |
|---|---|
| ***H01R 12/73*** | (2011.01) |
| ***H01R 13/6591*** | (2011.01) |
| ***H01R 13/6582*** | (2011.01) |
| ***H01R 13/6594*** | (2011.01) |
| *H01R 13/6581* | (2011.01) |
| *H01R 13/658* | (2011.01) |
| *H01R 12/51* | (2011.01) |
| *H01R 12/52* | (2011.01) |
| *H01R 13/71* | (2006.01) |
| *H01R 13/20* | (2006.01) |

(52) U.S. Cl.

CPC ..... *H01R 13/20* (2013.01); *H01R 13/658* (2013.01); *H01R 13/6581* (2013.01); *H01R 13/71* (2013.01)

ELECTRICAL CONNECTOR ASSEMBLY WITH SHIELDING SHELLS SURROUNDING EACH OF FIRST AND SECOND CONNECTORS

TECHNICAL FIELD

The present invention relates to a board-to-board connector and especially relates to a connector assembly in which board-to-board connectors are respectively mounted on boards and are connected with each other.

BACKGROUND ART

FIGS. 1A, 1B, 2A, 2B, and 3 illustrate the structure of a board-to-board connector described in Japanese Patent Application Laid Open No. 2017-33654 as an example of a related art. FIGS. 1A and 1B illustrate a first connector 10 constituting the board-to-board connector and FIGS. 2A and 2B illustrate a second connector 20 constituting the board-to-board connector. FIG. 3 illustrates a cross-sectional structure in a state in which the first connector 10 and the second connector 20 are fitted to each other.

The first connector 10 and the second connector 20 respectively include insulation housings 11 and 21 that are elongated to be slender. Many signal contact members 13 and 23 are aligned at a predetermined pitch along the longitudinal direction of the insulation housings 11 and 21 respectively in a multipolar state.

The insulation housings 11 and 21 include base end portions 11*a* and base end portions 21*a* respectively on both end portions in the longitudinal direction thereof (connector longitudinal direction). Further, a central convex portion 11*b* is formed to bridge the base end portions 11*a* and a central concave portion 21*b* is formed to bridge the base end portions 21*a*.

Conductive shells 12 and 22 respectively constitute shielding wall portions facing the signal contact members 13 and 23 and are respectively attached so as to surround the outer circumferential portions of the insulation housings 11 and 21. Here, the reference numerals 14 and 24 denote power source contact members in FIGS. 1A, 1B, 2A, and 2B.

The conductive shell 12 is composed of two substantially-L-shaped bodies. Thus, the pair of substantially-L-shaped bodies constitute a frame structure. A plurality of ground connection portions 12*c* are formed on the lower edge portions of longitudinal side wall plates 12*a* and short side wall plates 12*b* of the conductive shell 12. The ground connection portions 12*c* are soldered and coupled to a ground pad provided on a first wiring board 15.

The plurality of ground connection portions 12*c* are aligned at a predetermined interval on the longitudinal side wall plate 12*a* of the conductive shell 12. In an interval region between adjacent ground connection portions 12*c* making a pair, a side inspection window 12*d* is formed. The side inspection window 12*d* is composed of a space which enables board connection leg portions 13*a* of the signal contact members 13 to be visually observed toward the connector width direction. The side inspection window 12*d* is formed so that the length thereof in the connector longitudinal direction corresponds to the length in which three pieces of board connection leg portions 13*a* are aligned. Accordingly, a connection state of the board connection leg portions 13*a* and a connector assembly state can be checked from a side through the side inspection window 12*d*.

Further, a plane cover 12*e* is continuously formed on an upper edge portion of the longitudinal side wall plate 12*a* of the conductive shell 12. Contact pieces 12*f* are formed in a cut and raised manner on the plane cover 12*e* and a part which is bent and extended downward from the plane cover 12*e* to the longitudinal side wall plate 12*a*. The contact piece 12*f* has a leaf spring-like shape and comes into elastic contact with a fitting mate. A plurality of the contact pieces 12*f* are formed in the connector longitudinal direction at a predetermined interval.

Meanwhile, the conductive shell 22 formed as a shielding wall portion on the second connector 20 is composed of two substantially-U-shaped bodies. Thus, the pair of substantially-U-shaped bodies constitute a frame structure. A plurality of ground connection portions 22*c* are formed on the lower edge portions of longitudinal side wall plates 22*a* and fixing and locking pieces (short side wall plates) 22*b* of the conductive shell 22. The ground connection portions 22*c* are soldered and coupled to a ground pad provided on the second wiring board 25.

The plurality of ground connection portions 22*c* are aligned at a predetermined interval on the longitudinal side wall plate 22*a* of the conductive shell 22. In an interval region between adjacent ground connection portions 22*c* making a pair, a side inspection window 22*d* is formed. The side inspection window 22*d* is composed of a space which enables board connection leg portions 23*a* of the signal contact members 23 to be visually observed toward the connector width direction. The side inspection window 22*d* is formed so that the length thereof in the connector longitudinal direction corresponds to the length in which three pieces of board connection leg portions 23*a* are aligned. Accordingly, a connection state of the board connection leg portions 23*a* and a connector assembly state can be checked from a side through the side inspection window 22*d*.

In the state in which the first connector 10 mounted on the first wiring board 15 and the second connector 20 mounted on the second wiring board 25 are fitted to each other, the signal contact members 23 and the power source contact members 24 of the second connector 20 are accepted by and electrically connected with the signal contact members 13 and the power source contact members 14 of the first connector 10 respectively.

The conductive shell 22 formed in the second connector 20 is arranged so that the conductive shell 22 entirely covers the outer circumference of the first connector 10 from the outside when the first connector 10 and the second connector 20 are fitted to each other. In this state, inner wall surfaces of the conductive shell 22 of the second connector 20 are in elastic contact with the contact pieces 12*f* formed on the conductive shell 12 of the first connector 10. Accordingly, the conductive shells 12 and 22 are ground-connected with each other through the contact pieces 12*f*.

EMI countermeasures have become a more important issue for this type of board-to-board connector along with downsizing, high-density mounting, and use of higher frequency electric signals in electronic equipment using the board-to-board connector.

In the above-described board-to-board connector of the related art which is composed of the first connector 10 and the second connector 20, the first connector 10 and the second connector 20 respectively include the conductive shells 12 and 22 and the conductive shells 12 and 22 perform electromagnetic shielding. However, sufficient shielding effects have not been exhibited in terms of the following points.

First, the ground connection between the conductive shell 12 and the conductive shell 22 is realized when the plurality of contact pieces 12*f* formed on the conductive shell 12 come into elastic contact with the conductive shell 22. However, the contact pieces 12*f* are formed by cutting and raising the conductive shell 12, which forms gaps around the contact pieces 12*f* on the conductive shell 12. This causes a problem that electromagnetic waves are radiated from the gaps.

Second, in the state in which the first connector 10 and the second connector 20 are fitted to each other, the conductive shells 12 and 22 are arranged so that the conductive shells 12 and 22 are mutually overlapped in the inside and outside. However, there are gaps between these conductive shells 12 and 22 except for parts at which the contact pieces 12*f* are in contact with the conductive shell 22. This causes a problem that electromagnetic waves are radiated through the gaps.

BRIEF SUMMARY OF THE INVENTION

The object of the present invention is to provide a connector assembly, in which board-to-board connectors are respectively mounted on boards and are connected with each other, exhibiting superior shielding effects compared to the related art.

A first shell, having a rectangular shape, of a first connector includes a curved portion extending in a circumferential direction of the first shell and a second shell, having a rectangular shape, of a second connector includes a convex portion which extends in a circumferential direction of the second shell to be slender. In a connector assembly in which the first connector and the second connector are fitted to each other, the second shell is positioned in the inside of the first shell, the curved portion of the first shell protrudes toward the inside of the connector assembly, and the convex portion of the second shell protrudes toward the outside of the connector assembly. When the connector assembly is viewed in the direction in which the first connector is fitted to the second connector, the curved portion of the first shell and the convex portion of the second shell are overlapped with each other. In the connector assembly, the curved portion of the first shell is in contact with the second shell and the convex portion of the second shell is in contact with the first shell.

According to the present invention, the contact length between the first shell and the second shell of the first connector and the second connector is largely increased compared to the related art. Each of the first shell and the second shell has a rectangular frame-like shape and the contact length is the length in the direction along the frame. Thus, shielding effects can be enhanced compared to the related art and accordingly, a connector assembly for which EMI countermeasures are reinforced can be obtained.

LIST OF REFERENCE NUMERALS

Figure 1A:
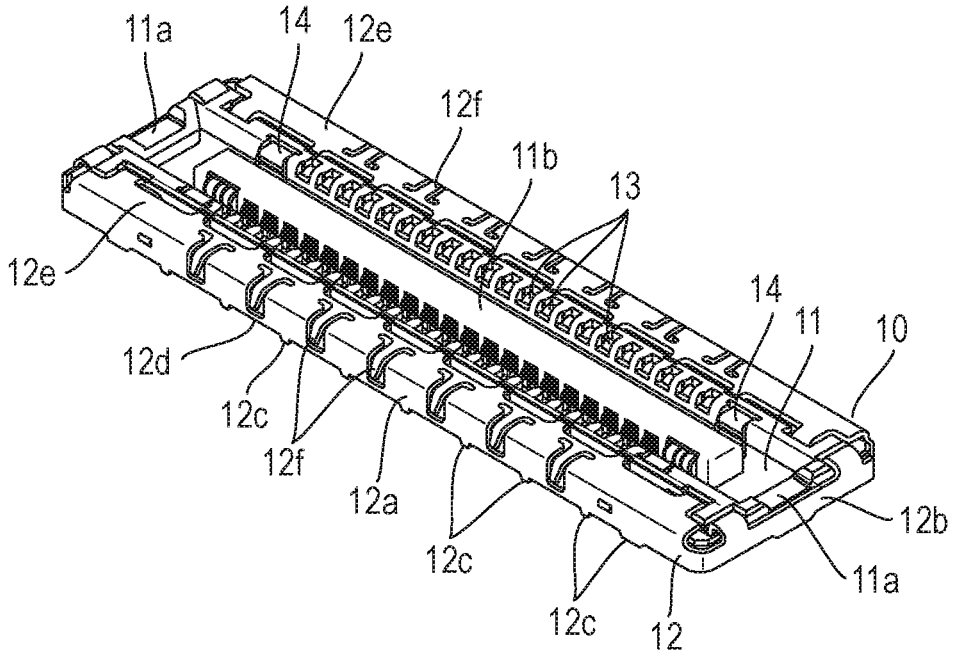
FIG. 1A (PRIOR ART)
FIG. 1A is a perspective view illustrating a first connector of a board-to-board connector in an example of a related art.
Figure 1B:
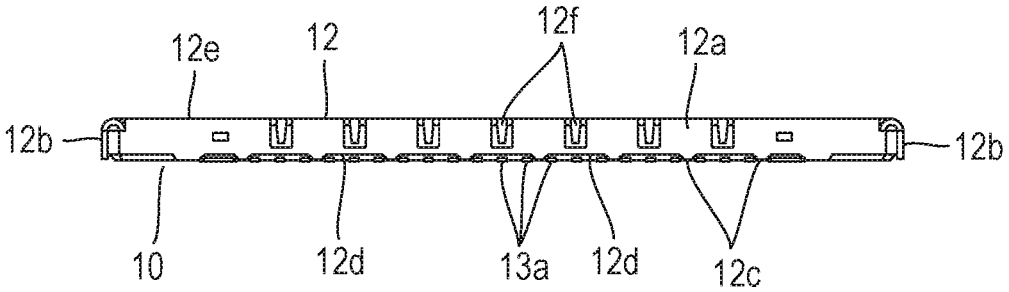
FIG. 1B (PRIOR ART)
FIG. 1B is a front elevational view illustrating the first connector of the board-to-board connector in the example of the related art.
Figure 2A:
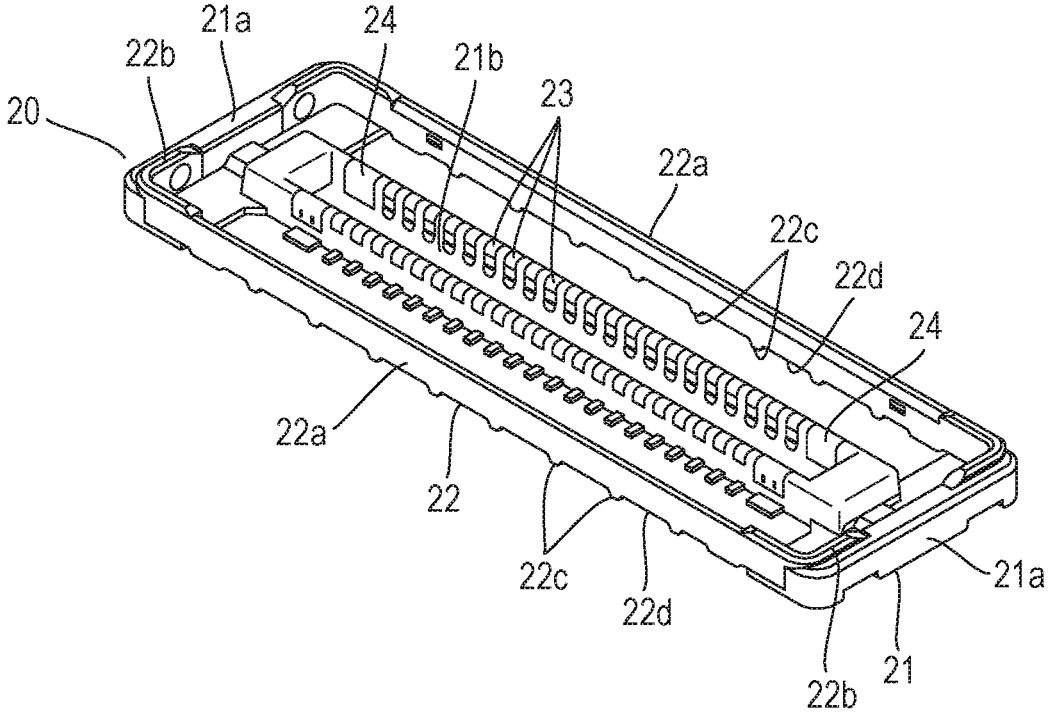
FIG. 2A (PRIOR ART)
FIG. 2A is a perspective view illustrating a second connector of the board-to-board connector in the example of the related art.
Figure 2B:
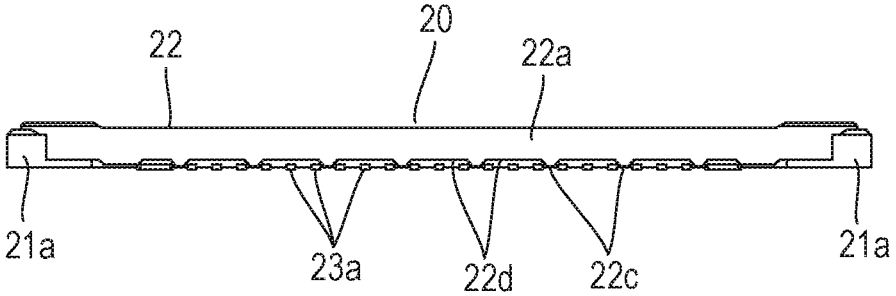
FIG. 2B (PRIOR ART)
FIG. 2B is a front elevational view illustrating the second connector of the board-to-board connector in the example of the related art.
Figure 3:
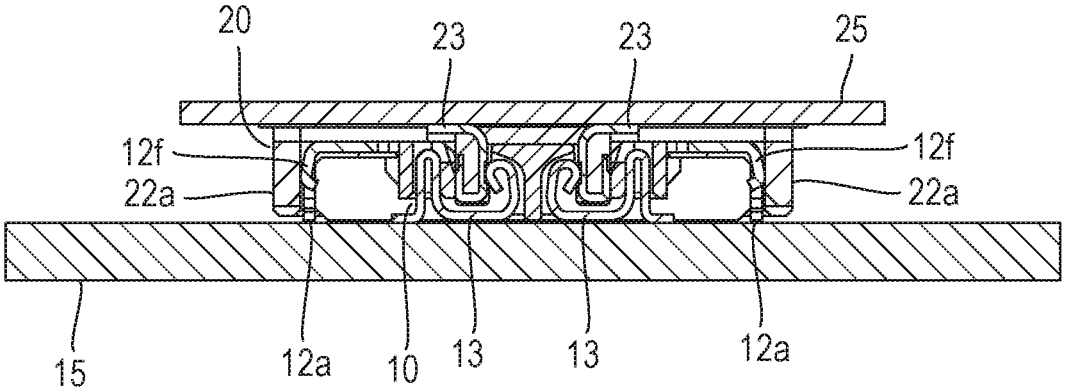
FIG. 3 (PRIOR ART)
FIG. 3 is an enlarged sectional view illustrating a fitting state between the first connector illustrated in FIG. 1A and the second connector illustrated in FIG. 2A with wiring boards.

10: first connector
11: insulation housing
11*a*: base end portion
11*b*: central convex portion
12: conductive shell
12*a*: longitudinal side wall plate
12*b*: short side wall plate
12*c*: ground connection portion
12*d*: side inspection window
12*e*: plane cover
12*f*: contact piece
13: signal contact member

13*a*: board connection leg portion
14: power source contact member
15: first wiring board
20: second connector
21: insulation housing
21*a*: base end portion
21*b*: central concave portion
22: conductive shell
22*a*: longitudinal side wall plate
22*b*: fixing and locking piece
22*c*: ground connection portion
22*d*: side inspection window
23: signal contact member
23*a*: board connection leg portion
24: power source contact member
25: second wiring board
30: insulator
31: concave portion
32: slit
41, 42: terminal
41*a*, 42*a*: contact piece
41*b*, 42*b*: connection portion
50: first shell
50': half body
51, 52: outer wall portion
51*a*, 52*a*: curved portion
51*b*: cutout
51*c*: carrier cut portion
51*d*: carrier cut surface
53: extension portion
53*a*: raised portion
53*b*: protrusion
54: U-shaped portion
54*a*: leg portion
55: cutout
56: gap
57: cutout
58: notch
59: carrier
60: insulator
61: bottom plate portion
62: side wall
63: concave portion
71, 72: terminal
71*a*, 72*a*: connection portion
73: shielding plate
73*a*: columnar portion
73*b*: elongated portion
80: second shell
81, 82: outer wall portion
81*a*, 82*a*: convex portion
81*b*: extension portion
82*b*: protrusion
83: coupling portion
83*a*: carrier cut portion
84, 85, 86: cutout
87: separation part
100: first connector
200: second connector
300: first board
310: first ground pattern
320: first soldering part
400: second board
410: second ground pattern
420: second soldering part

DETAILED DESCRIPTION

An embodiment of the present invention will be described based on an example with reference to the accompanying drawings.

Figure 4A:
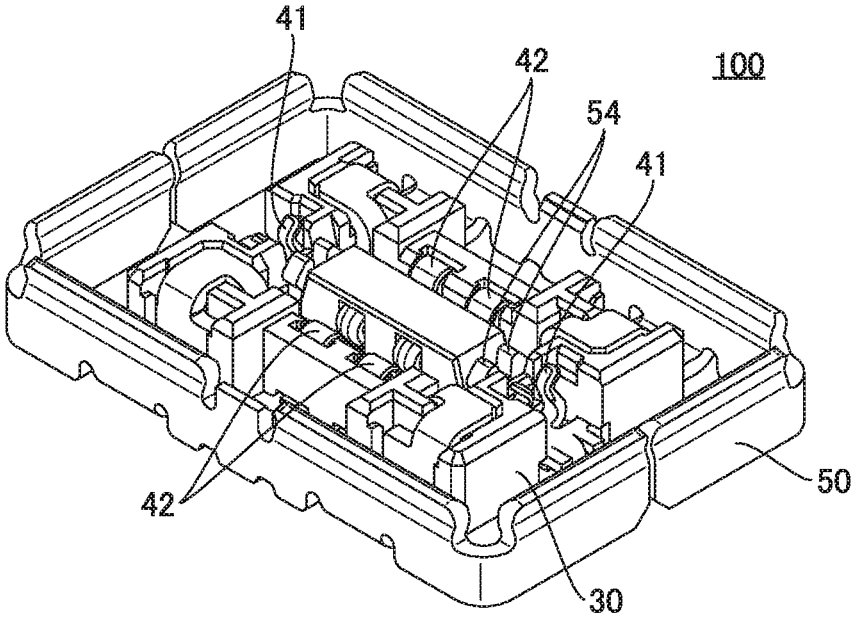
FIG. 4A is an upper perspective view illustrating a first connector constituting a connector assembly according to an embodiment of the present invention.
Figure 4B:
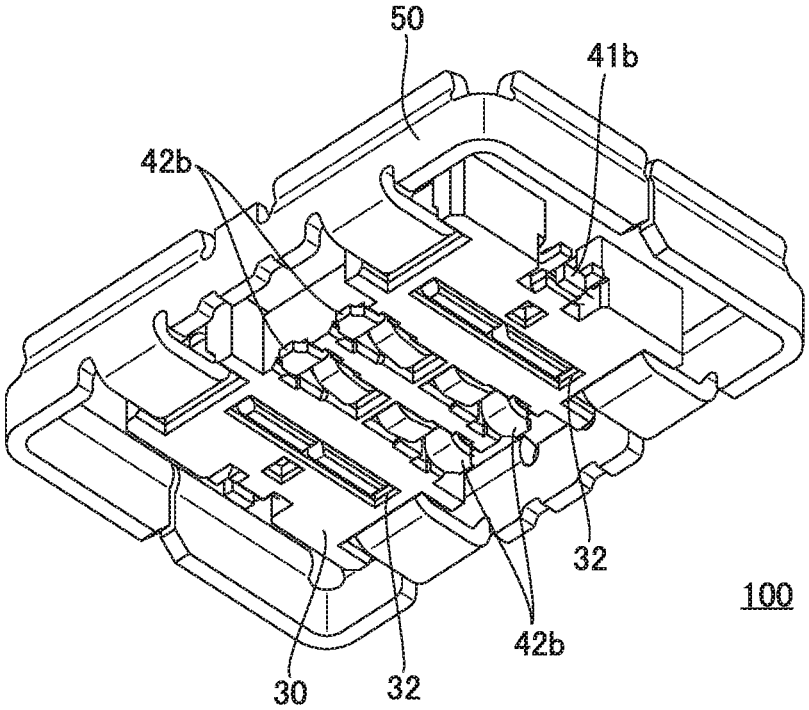
FIG. 4B is a lower perspective view illustrating the first connector in FIG. 4A.
Figure 5:
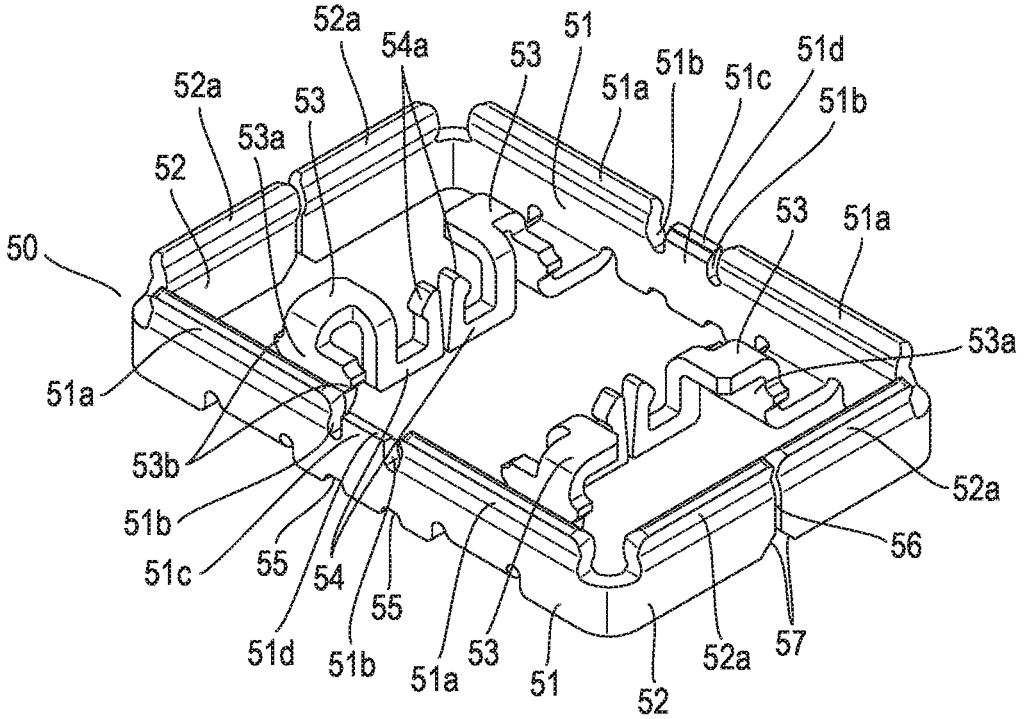
FIG. 5 is a perspective view illustrating a first shell in FIG. 4A.
Figure 6:
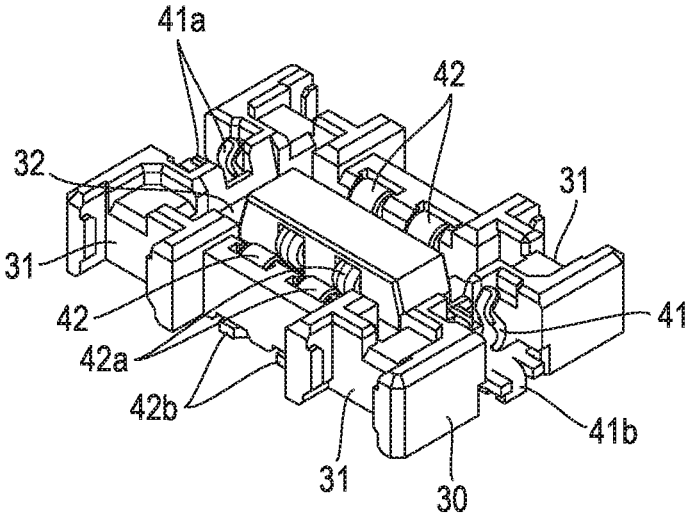
FIG. 6 is a perspective view illustrating an insulator and terminals held by the insulator in FIG. 4A.

FIGS. 4A and 4B illustrate a first connector 100 constituting a connector assembly according to an embodiment of the present invention. The first connector 100 is composed of an insulator 30, terminals 41 and 42 which are held by the insulator 30, and a first shell 50 which serves as an outer shell of the first connector 100 and has a rectangular frame-like shape. FIG. 5 illustrates details of the first shell 50 and FIG. 6 illustrates a state in which the first shell 50 is removed from the first connector 100.

The insulator 30 is made of resin and has a substantially rectangular parallelepiped shape as a whole. The terminals 41 are respectively attached to both longitudinal end portions of the insulator 30, and two terminals 42 for each of two columns, that is, four terminals 42 in total are attached to the central portion of the insulator 30.

The terminal 41 includes a pair of contact pieces 41*a* which face each other, and the terminal 42 also includes a pair of contact pieces 42*a* which face each other. Connection portions 41*b* and 42*b*, which are to be connected with a board, of the terminals 41 and 42 are positioned on the bottom surface side of the insulator 30. The two terminals 41 are used for high frequency signals (high speed transmission) and the four terminals 42 are used for low frequency signals (low speed transmission) in this example.

The first shell 50 is formed through bending processing for metal plate, and the rectangular frame structure thereof is composed of two bodies having substantially-U-shaped outer walls. On upper ends of outer wall portions 51 respectively positioned on two opposed long sides of the rectangle and on upper ends of outer wall portions 52 respectively positioned on two opposed short sides of the rectangle, curved portions 51*a* and curved portions 52*a* are formed respectively. The curved portions 51*a* and 52*a* have shapes that are bent to slightly protrude toward the inside of the rectangular frame and then reversely bent to protrude toward the outside of the frame.

The curved portion 51*a* of the outer wall portion 51 is formed on part excluding the central portion in the side direction of the outer wall portion 51, and a carrier cut portion 51*c* is positioned between a pair of cutouts 51*b* on the central portion in the side direction of the outer wall portion 51. The upper end surface of the carrier cut portion 51*c* is a carrier cut surface 51*d*.

On two positions on the lower end of each outer wall portion 51, extension portions 53 are formed in a manner to be bent and extended toward the inside of the frame. The extension portions 53 of both outer wall portions 51 make pairs and are formed so that the extension portions 53 in a pair are extended to approach each other. In other words, two pairs of extension portions 53 are formed on the first shell 50.

The extension portions 53 making a pair are structured such that the extension portions 53 are extended from the outer wall portions 51 to mutually approach and then bent and raised to form raised portions 53*a*, and are extended from the upper ends of these raised portions 53*a* to further approach each other, and are bent downward from the extended ends to form U-shaped portions 54 having a U shape opening upward on the ends thereof. The U-shaped portions 54 of the extension portions 53 making a pair are positioned on the same plane and one leg portions 54*a*, which are positioned on the end sides, of respective U shapes are close to each other. A pair of protrusions 53*b* are formed on the raised portion 53*a* in a manner to protrude in the width direction.

On part between two extension portions 53 on the lower end of each outer wall portion 51, two small cutouts 55 are formed. The cutouts 55 are provided to respectively correspond to the positions of the connection portions 42*b* of the terminals 42 held by the insulator 30. The connection portions 42*b* are exposed to the bottom surface side of the insulator 30. Meanwhile, a slight gap 56 is formed in each outer wall portion 52 as an abutment part of the first shell 50 constituted by two bodies, and cutouts 57 which are like chamfers are formed on part, corresponding to the gap 56, of the lower end of the outer wall portion 52.

Figure 7A:
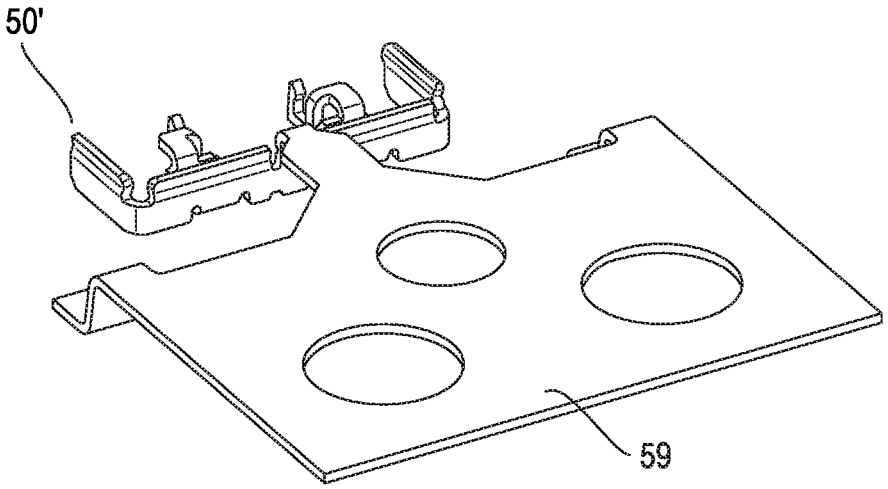
FIG. 7A is a perspective view illustrating a state before cutting and removing a carrier of a half body constituting the first shell illustrated in FIG. 5.
Figure 7B:
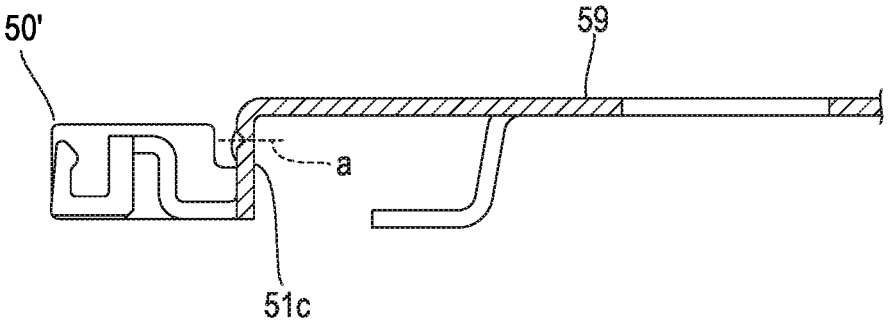
FIG. 7B is a partially-enlarged sectional view of FIG. 7A.

FIGS. 7A and 7B illustrate a state before cutting and removing a carrier in a manufacturing process for the first shell 50 having the above described structure. The reference numeral 50' in FIGS. 7A and 7B denotes a half body of the first shell 50 composed of two bodies and the reference numeral 59 denotes a carrier. The carrier 59 serves as a reference for a mold for performing processing such as bending processing, and the processing can be accurately performed when the half body 50' is thus held by the carrier 59. A dashed line a in FIG. 7B represents a cutting position on which the carrier 59 is cut and removed. The cutouts 51*b* are formed on both sides of the carrier cut portion 51*c* as illustrated in FIG. 5, so a cutting work can be easily and favorably performed.

The first shell 50 is attached to the insulator 30 holding the terminals 41 and 42. The attachment of the first shell 50 is performed by putting the two half bodies 50' of the first shell 50 over the insulator 30 and forcing the half bodies 50' into the insulator 30. At this time, the raised portions 53*a* including the protrusions 53*b* in four extension portions 53 are pressed into four concave portions 31 of the insulator 30 respectively. In addition, the U-shaped portions 54 of a pair of extension portions 53 are inserted into a slit 32 of the insulator 30. Thus, the first connector 100 illustrated in FIGS. 4A and 4B is completed.

Figure 8A:
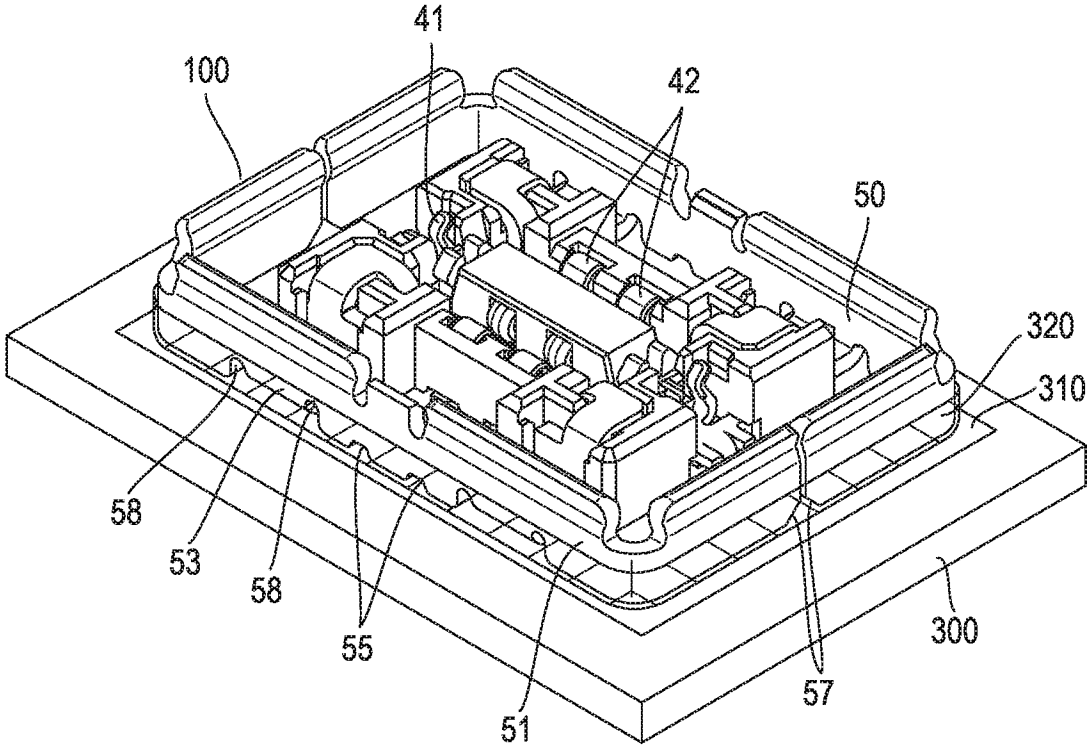
FIG. 8A is a perspective view illustrating a state in which the first connector illustrated in FIG. 4A is mounted on a first board.
Figure 8B:
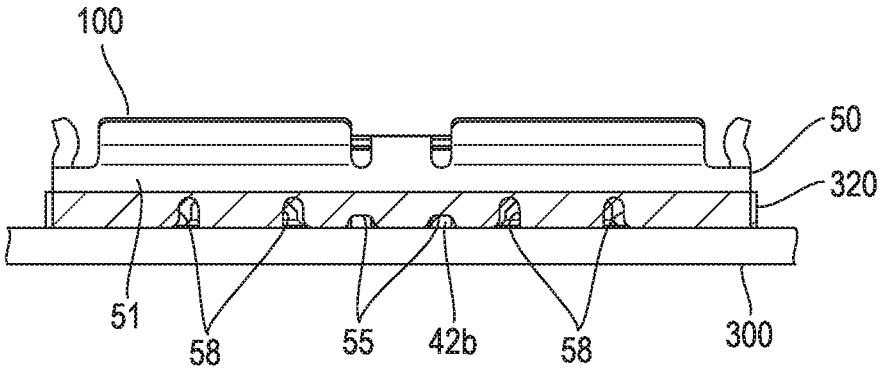
FIG. 8B is a front elevational view illustrating the state in which the first connector illustrated in FIG. 4A is mounted on the first board.

FIGS. 8A and 8B illustrate a state in which the first connector 100 illustrated in FIGS. 4A and 4B is mounted on a first board 300. Hidden and not seen in FIGS. 8A and 8B, the connection portions 41*b* and 42*b* of the terminals 41 and 42 are soldered on a pad of the first board 300. The connection portion 42*b* of the terminal 42 can be visually observed from the outside of the outer wall portion 51 of the first shell 50 through the cutout 55, so the position and the soldering state of the connection portion 42*b* can be checked.

Further, a first ground pattern 310 having a rectangular frame-like shape is formed on the first board 300 in a manner to correspond to the frame-like shape of the first shell 50 in this example. The first shell 50 and the first ground pattern 310 are soldered and connected to each other through the entire circumference by a first soldering part 320 composed of a solder fillet provided along the first ground pattern 310. The first soldering part 320 is drawn without any colors and is hatched in FIGS. 8A and 8B.

On the lower ends of the first shell 50 which face the first board 300, there are the cutouts 55 and 57 and there also are notches 58, which make it easy to bend the extension portion 53, on both sides of part, on which the extension portion 53 is formed, of the lower end of the first shell 50. However, all of these cutouts 55 and 57 and notches 58 are closed by the first soldering part 320 as illustrated in FIGS. 8A and 8B.

A second connector 200 that is to be connected with the above-described first connector 100 to constitute the board-to-board connector will now be described.

Figure 9A:
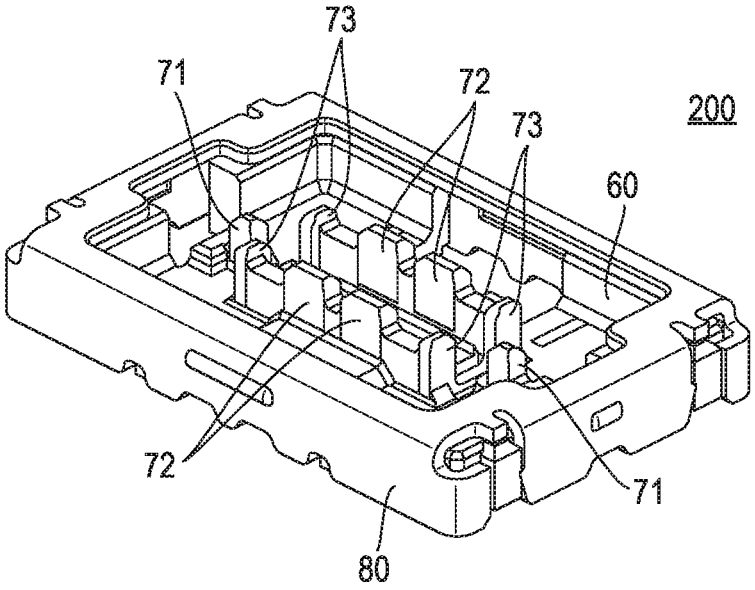
FIG. 9A is an upper perspective view illustrating a second connector constituting the connector assembly according to the embodiment of the present invention.
Figure 9B:
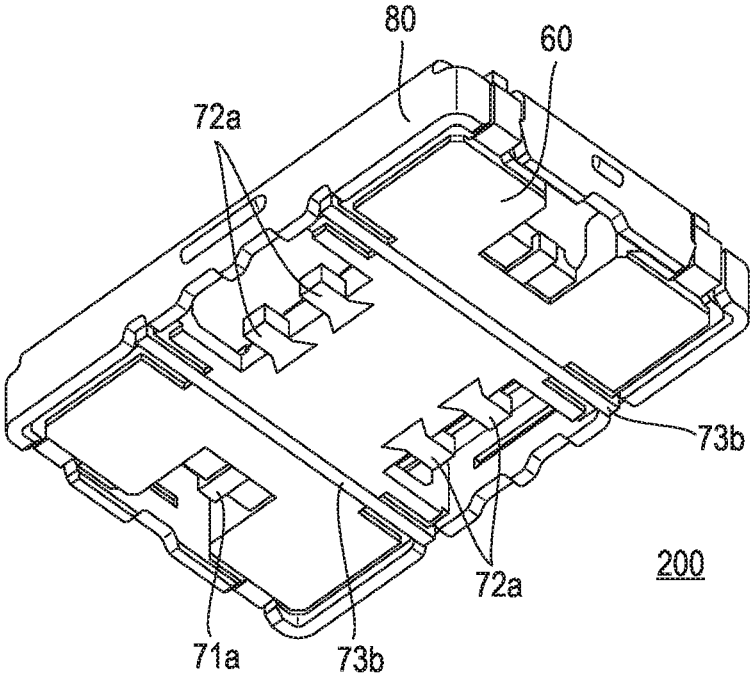
FIG. 9B is a lower perspective view illustrating the second connector in FIG. 9A.
Figure 10:
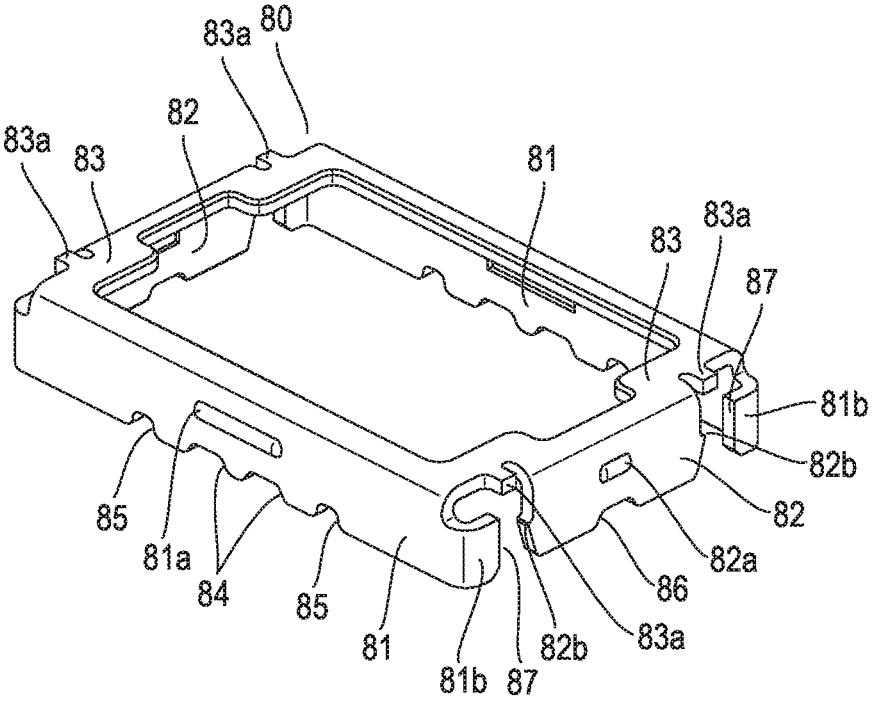
FIG. 10 is a perspective view illustrating a second shell in FIG. 9A.
Figure 11:
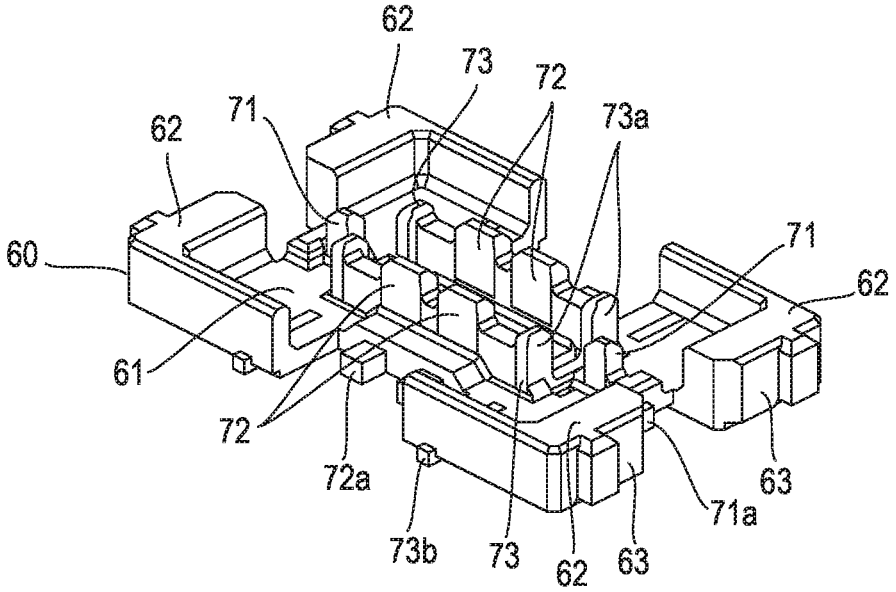
FIG. 11 is a perspective view illustrating an insulator and terminals held by the insulator in FIG. 9A.

FIGS. 9A and 9B illustrate the second connector 200. The second connector 200 is composed of an insulator 60, terminals 71 and 72 and shielding plates 73 which are held by the insulator 60, and a second shell 80 which serves as an outer shell of the second connector 200 and has a rectangular frame-like shape. FIG. 10 illustrates details of the second shell 80 and FIG. 11 illustrates a state in which the second shell 80 is removed from the second connector 200.

The insulator 60 is made of resin and includes a bottom plate portion 61 and side walls 62 which are respectively provided on four corner portions of the bottom plate portion 61. The terminals 71 are respectively attached to both longitudinal end portions of the bottom plate portion 61, and two terminals 72 for each of two columns, that is, four terminals 72 in total are attached to the central portion of the bottom plate portion 61. Further, the shielding plate 73 is attached between each of the two terminals 71 and the four terminals 72.

The terminal 71 has a columnar shape and includes a connection portion 71*a*, which is to be connected with a board, on the lower end thereof. The terminal 72 has a plate-like shape and includes a connection portion 72*a*, which is to be connected with the board, on the lower end thereof. The two terminals 71 are used for high frequency signals and the four terminals 72 are used for low frequency signals.

The shielding plate 73 is composed of a pair of columnar portions 73*a* that protrudes on the bottom plate portion 61 and elongated portions 73*b* that are elongated in a manner to couple and support the lower ends of the columnar portions 73*a*. The elongated portions 73*b* serve as connection portions to be connected with the board.

The second shell 80 which has a rectangular frame-like shape is formed through bending processing for metal plate. As illustrated in FIG. 10, the second shell 80 includes outer wall portions 81, outer wall portions 82, and coupling portions 83. The outer wall portions 81 are respectively positioned on two opposed long sides of the rectangle. The outer wall portions 82 are respectively positioned on two opposed short sides of the rectangle. The coupling portions 83 couple the upper ends of the outer wall portions 81 and the upper ends of the outer wall portions 82 to each other. The coupling portions 83 have plate surfaces that protrude to the inside of the frame to slightly narrow the frame formed by the outer wall portions 81 and 82.

Slender convex portions 81*a* are respectively formed on the central portions in the side direction on the outer surfaces of the pair of outer wall portions 81 in a manner to be elongated along the sides, and slender convex portions 82*a* are also respectively formed on the central portions in the side direction on the outer surfaces of the pair of outer wall portions 82 in a manner to be elongated along the sides. On both ends in the side direction of the pair of outer wall portions 81, extension portions 81*b* are formed in a manner to be bent and extended toward the outer wall portion 82.

Two cutouts 84 are formed on the lower end of each outer wall portion 81, and cutouts 85 are further formed on both outer sides in the side direction of the two cutouts 84. The cutouts 84 are formed to correspond to the positions of the connection portions 72*a* of the terminals 72 which are held by the insulator 60. The connection portions 72*a* are exposed on the bottom surface side of the insulator 60. The cutouts 85 are formed to correspond to the positions of the elongated portions 73*b* of the shielding plates 73 which are held by the insulator 60. The elongated portions 73*b* are exposed on the bottom surface side of the insulator 60. Cutouts 86 are also formed on the lower ends of respective outer wall portions 82, and protrusions 82*b* are formed on both ends in the side direction of each outer wall portion 82 in a manner to mutually protrude outward. Here, the reference character 83*a* in FIG. 10 denotes a carrier cut portion, and four carrier cut portions 83*a* are formed on the coupling portions 83 respectively.

The second shell 80 having the above-described structure is attached to the insulator 60 that holds the terminals 71 and 72 and the shielding plates 73. The attachment of the second shell 80 is performed by putting the second shell 80 over the insulator 60 and forcing the second shell 80 into the insulator 60. Each of the outer wall portions 82 including the protrusions 82*b* is pressed into a concave portion 63 that is formed on the outer sides of the side walls 62 of the insulator 60 in a manner to straddle two side walls 62. As a result, the second connector 200 illustrated in FIGS. 9A and 9B is completed.

Figure 12A:
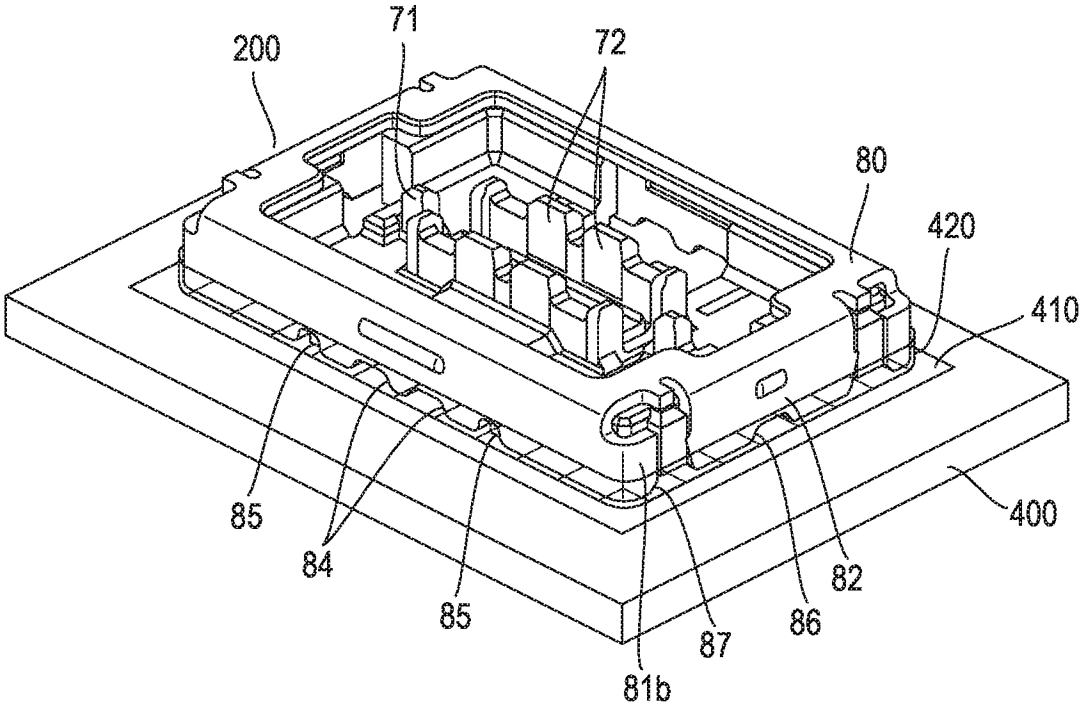
FIG. 12A is a perspective view illustrating a state in which the second connector illustrated in FIG. 9A is mounted on a second board.
Figure 12B:
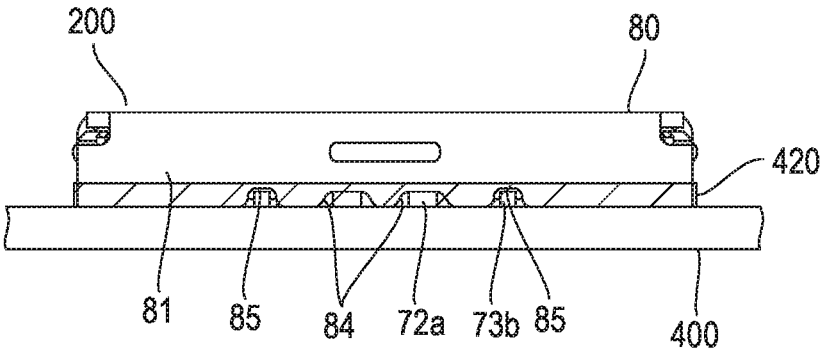
FIG. 12B is a front elevational view illustrating the state in which the second connector illustrated in FIG. 9A is mounted on the second board.

FIGS. 12A and 12B illustrate a state in which the second connector 200 illustrated in FIGS. 9A and 9B is mounted on a second board 400. Hidden and not seen in FIGS. 12A and 12B, the connection portions 71*a* and 72*a* of the terminals 71 and 72 are soldered on a pad of the second board 400. The connection portion 72*a* of the terminal 72 can be visually observed from the outside of the outer wall portion 81 of the second shell 80 through the cutout 84, so the position and the soldering state of the connection portion 72*a* can be checked.

Further, a second ground pattern 410 having a rectangular frame-like shape is formed on the second board 400 in a manner to correspond to the frame-like shape of the second shell 80 in this example. The second shell 80 and the second ground pattern 410 are soldered and connected to each other through the entire circumference by a second soldering part 420 composed of a solder fillet provided along the second ground pattern 410. The second soldering part 420 is drawn without any colors and is hatched in FIGS. 12A and 12B.

On the lower ends of the second shell 80 which face the second board 400, there are the cutouts 84 to 86 and there also are separation parts 87 between each outer wall portion 82 and the extension portions 81*b*. The separation parts 87 separate the outer wall portion 82 from the extension portions 81*b* which are positioned on both sides of the outer wall portion 82. However, all of these cutouts 84 to 86 and separation parts 87 are closed by the second soldering part 420 as illustrated in FIGS. 12A and 12B. Here, both ends of the elongated portions 73*b* of the shielding plate 73 are positioned on the cutouts 85 and are soldered on the second ground pattern 410 together with the second shell 80 by the second soldering part 420.

Figure 13A:
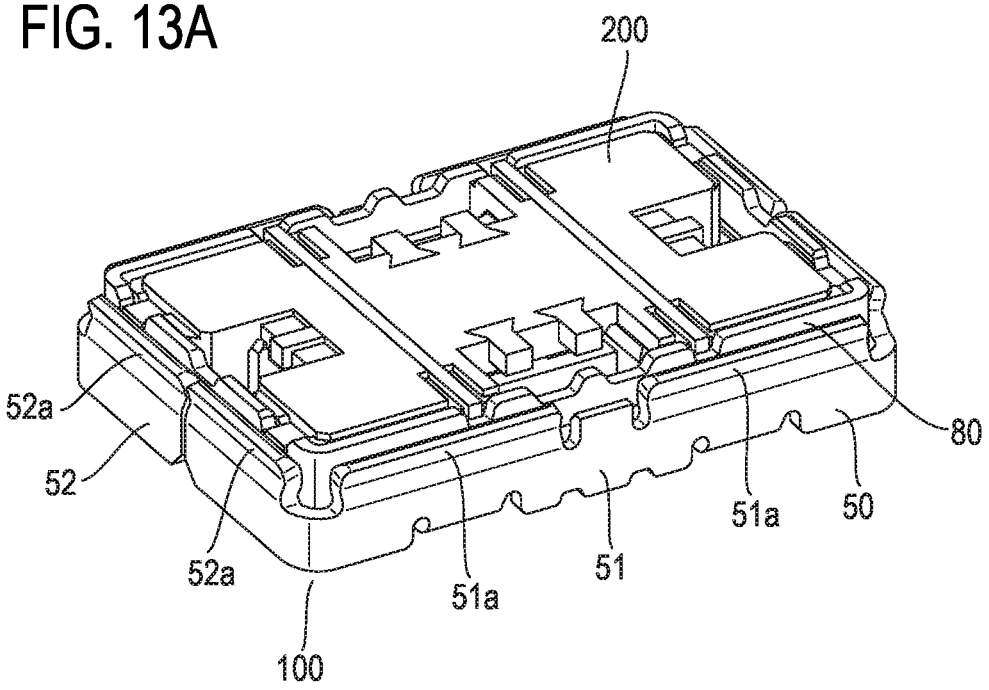
FIG. 13A is a perspective view illustrating a connecting state between the first connector illustrated in FIG. 4A and the second connector illustrated in FIG. 9A.
Figure 13B:
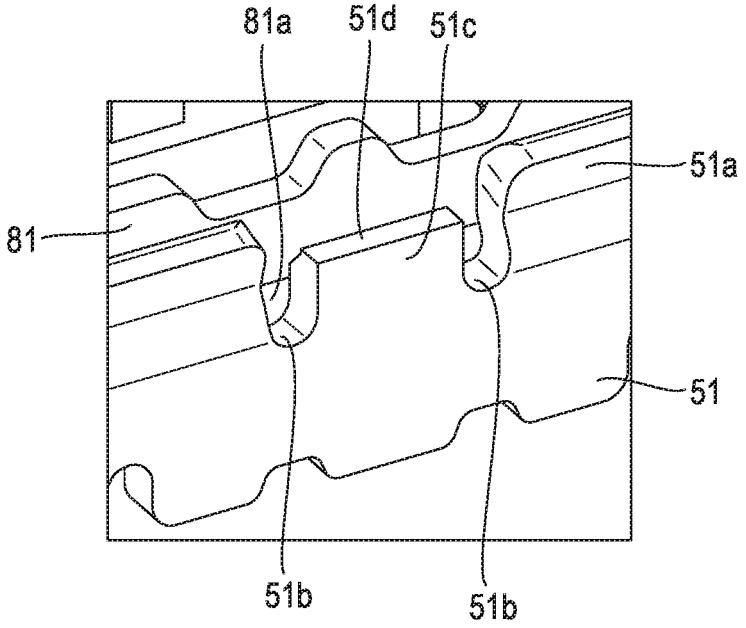
FIG. 13B is a partially-enlarged view of FIG. 13A.
Figure 14A:
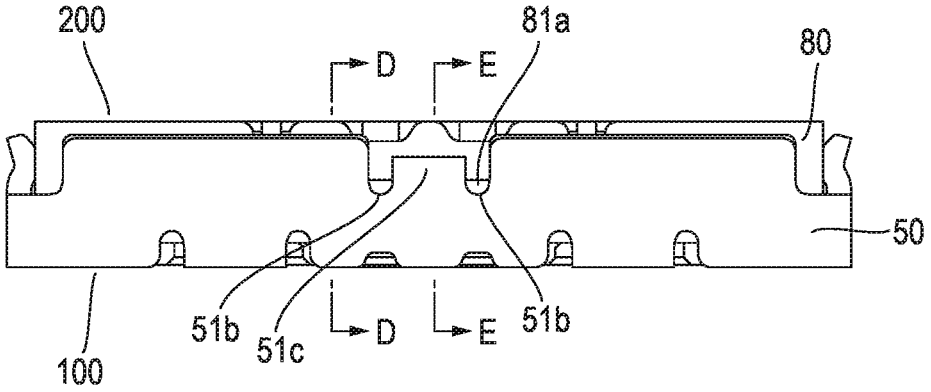
FIG. 14A is a front elevational view illustrating the connecting state between the first connector illustrated in FIG. 4A and the second connector illustrated in FIG. 9A.
Figure 14B:
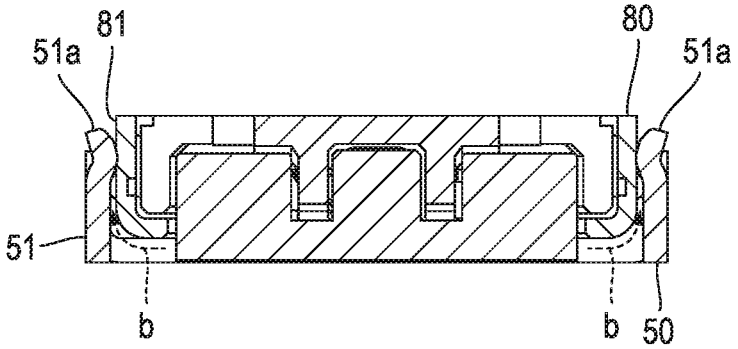
FIG. 14B is a sectional view taken along a D-D line in FIG. 14A.
Figure 14C:
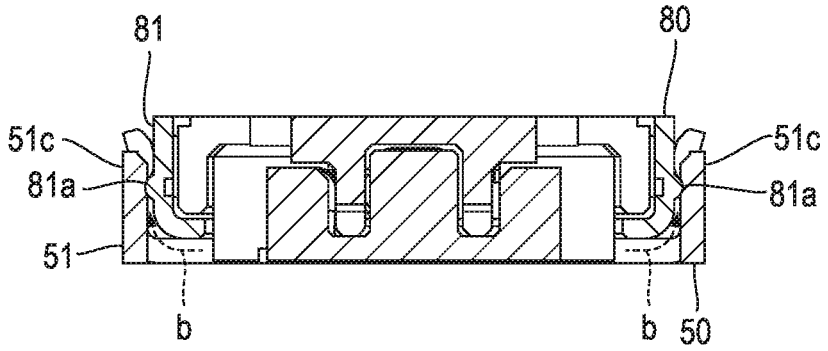
FIG. 14C is a sectional view taken along an E-E line in FIG. 14A.

The first board 300 and the second board 400 are opposed to each other and the first connector 100 and the second connector 200 which are respectively mounted on the opposing surfaces of the first board 300 and the second board 400 are fitted and connected to each other. Thus, the connector assembly according to the present invention is structured. FIGS. 13A and 14A illustrate a state in which the first connector 100 and the second connector 200 are fitted and connected to each other, omitting the illustration of the first board 300 and the second board 400. FIGS. 14B and 14C illustrate cross-sectional structures of the same. FIG. 13B is a partially-enlarged view of FIG. 13A.

The second connector 200 is fitted and housed in the first shell 50, having the rectangular frame-like shape, of the first connector 100. Here, the curved portions 51*a* and 52*a* are formed on the upper ends, which face the second board 400, of the outer wall portions 51 and 52 of the first shell 50, favorably leading the second connector 200 toward the inside of the first shell 50.

Through the fitting of the second connector 200 to the first connector 100, the terminals 41 and 42 are respectively fitted and connected to the terminals 71 and 72. The convex portions 81*a* and 82*a* formed on the second shell 80 are fitted to deeper positions than the curved portions 51*a* and 52*a* of the first shell 50 respectively (positioned on the closer side to the first board 300 than the curved portions 51*a* and 52*a*) and thus, the second shell 80 is fitted in the inside of the first shell 50. The convex portions 81*a* and 82*a* of the second shell 80 respectively come into contact with the inner surfaces of the outer wall portions 51 and 52, which are opposed to each other, of the first shell 50 through the entire lengths thereof, and the curved portions 51*a* and 52*a* of the first shell 50 respectively come into contact with the outer surfaces of the outer wall portions 81 and 82, which are opposed to each other, of the second shell 80 through the entire lengths thereof. When the both end portions in the elongation direction of the convex portion 81*a* and the convex portion 82*a* ride over the curved portions 51*a* and 52*a* and fit to the deeper positions of the curved portions 51*a* and 52*a* respectively, operators and the like can obtain a click feeling.

Meanwhile, the leg portions 54*a*, which are close to each other, of respective U-shaped portions 54 making a pair and formed on the first shell 50 are positioned so that the leg portions 54*a* are fitted between a pair of columnar portions 73*a* of the shielding plate 73 and substantially fill the gap between the pair of columnar portions 73*a*. Accordingly, shields are formed between the terminals 41, 71 for high frequency signals and the terminals 42, 72 for low frequency signals.

The connector assembly according to the embodiment of the present invention has been described thus far. According to the present embodiment, the following advantageous effects can be obtained.

(1) The first shell 50 of the first connector 100 and the second shell 80 of the second connector 200 do not include any contact pieces of the related art that are formed by cutting and raising the shell and have gaps therearound, being free from electromagnetic wave radiation through gaps. Thus, shielding effects are enhanced compared to the related art.

(2) In the state in which the first connector 100 and the second connector 200 are fitted and connected to each other, the first shell 50 and the second shell 80 having the rectangular frame-like shapes constitute the structure: the convex portions 81*a* and 82*a*, which are respectively formed on the outer wall portions 81 and 82 of the second shell 80 to be elongated along sides, are respectively in contact with the outer wall portions 51 and 52 of the first shell 50 through the entire lengths thereof, and the curved portions 51*a* and 52*a* of the first shell 50 are respectively in contact with the outer wall portions 81 and 82 of the second shell 80 through the entire lengths thereof. The curved portions 51*a* and 52*a* and the convex portions 81*a* and 82*a* are positioned not to be completely overlapped but to be partially overlapped with each other when viewed from the fitting direction between the first connector 100 and the second connector 200. However, the curved portions 51*a* and 52*a* and the convex portions 81*a* and 82*a* are positioned so that the curved portions 51*a* and 52*a* and the convex portions 81*a* and 82*a* complementarily form a rectangular frame-like shape. Accordingly, the first shell 50 and the second shell 80 have almost no gaps therebetween because of the presence of these curved portions 51*a* and 52*a* and convex portions 81*a* and 82*a*, and the shielding effects can be thus largely enhanced. Arrows b drawn with a dashed line in FIGS. 14B and 14C represent entry of electromagnetic waves to gaps between the first shell 50 and the second shell 80. FIGS. 14B and 14C show that the presence of the curved portions 51*a* in FIG. 14B and the presence of the convex portions 81*a* in FIG. 14C prevent electromagnetic waves from radiating.

(3) Further, the cutouts 55 and 57 and notches 58 that are formed on the lower ends, which face the first board 300, of the first shell 50 and the cutouts 84 to 86 and separation parts 87 that are formed on the lower ends, which face the second board 400, of the second shell 80 are filled with solder. Therefore, radiation of electromagnetic waves from these parts can be prevented.

In this example, the carrier cut portion 51*c* is positioned on the upper end side of the first shell 50 of the first connector 100 and the cutouts 51*b* for facilitating a cutting work are formed on both sides of the carrier cut portion 51*c*. The curved portion 51*a* is not provided to this part, so the gap between the first shell 50 and the second shell 80 is not closed by the curved portion 51*a*. However, the gap is closed by the convex portion 81*a* of the second shell 80 as illustrated in FIG. 14B. The depth of the cutout 51*b* is set not to impair the contact between the convex portion 81*a* and the first shell 50 on a part on which the cutout 51*b* is positioned (position in the side direction).

As described above, the carrier cut portion 51*c* is formed on the upper end side of the outer wall portion 51 in the first shell 50 in this example. If a carrier cut portion is formed on the lower end side of the outer wall portion 51, for example, there is a problem in that the carrier cut portion impairs soldering with the first ground pattern 310 of the first board 300. Also, if a carrier cut portion is formed on an extended part in the side direction of the outer wall portion 52, there may be a problem in that the carrier cut portion impairs the abutment of the first shell 50 composed of two bodies. Thus, it is favorable to form the carrier cut portion 51*c* on the upper end side of the outer wall portion 51 as this example.

The first shell 50 and the second shell 80 both have the rectangular frame-like shapes in the above-described embodiment. However, the frame shape is not limited to a rectangular shape, but may be a substantially rectangular shape whose four corner portions are rounded or may be an elliptical shape, for example.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector assembly in which a first connector and a second connector are respectively mounted on opposing surfaces of a first board and a second board, the first board and the second board being opposed to each other, and are fitted to each other, wherein a first shell, the first shell having a rectangular frame-like shape and being made of a metal plate and serving as an outer shell of the first connector, includes a curved portion on an upper end of each side in a rectangle of the rectangular frame-like shape, the upper end facing the second board, the curved portion having a shape that is bent to protrude toward an inside of a rectangular frame of the rectangular frame-like shape and then reversely bent to protrude toward an outside of the rectangular frame, a second shell, the second shell having a rectangular frame-like shape and being made of a metal plate and serving as an outer shell of the second connector, includes a convex portion on an outer surface on a side of a rectangle of the rectangular frame-like shape, the convex portion being elongated along the side to be slender, the curved portion and the convex portion are positioned so that the curved portion and the convex portion are not completely overlapped but are partially overlapped with each other and complementarily form the rectangular frame-like shape when viewed from a fitting direction between the first connector and the second connector, the second shell is housed in the first shell so that the convex portion is positioned closer to the first board than the curved portion, and the convex portion is in contact with the first shell through an entire length thereof, and the curved portion is in contact with the second shell through an entire length thereof.

2. The connector assembly according to claim 1, wherein there is a cutout on the upper end of the first shell, and a depth of the cutout is set not to impair contact between the convex portion and the first shell on a position, on which the cutout is positioned, in a side direction of the rectangle.

3. The connector assembly according to claim 2, wherein a part between two pieces of the cutouts on the upper end of the first shell is a carrier cut portion.

4. The connector assembly according to claim 1, wherein a first ground pattern having a frame-like shape is formed on the first board, and the first shell and the first ground pattern are soldered and connected to each other through an entire circumference by a first soldering part provided along the first ground pattern, and a second ground pattern having a frame-like shape is formed on the second board, and the second shell and the second ground pattern are soldered and connected to each other through an entire circumference by a second soldering part provided along the second ground pattern.

5. The connector assembly according to claim 2, wherein a first ground pattern having a frame-like shape is formed on the first board, and the first shell and the first ground pattern are soldered and connected to each other through an entire circumference by a first soldering part provided along the first ground pattern, and a second ground pattern having a frame-like shape is formed on the second board, and the second shell and the second ground pattern are soldered and connected to each other through an entire circumference by a second soldering part provided along the second ground pattern.

6. The connector assembly according to claim 3, wherein a first ground pattern having a frame-like shape is formed on the first board, and the first shell and the first ground pattern are soldered and connected to each other through an entire circumference by a first soldering part provided along the first ground pattern, and a second ground pattern having a frame-like shape is formed on the second board, and the second shell and the second ground pattern are soldered and connected to each other through an entire circumference by a second soldering part provided along the second ground pattern.

7. The connector assembly according to claim 4, wherein there is a cutout on a lower end of the first shell, the lower end facing the first board, and the cutout on the lower end is closed by the first soldering part.

8. The connector assembly according to claim 5, wherein there is a cutout on a lower end of the first shell, the lower end facing the first board, and the cutout on the lower end is closed by the first soldering part.

9. The connector assembly according to claim 6, wherein there is a cutout on a lower end of the first shell, the lower end facing the first board, and the cutout on the lower end is closed by the first soldering part.

10. The connector assembly according to claim 4, wherein there is a cutout on a lower end of the second shell, the lower end facing the second board, and the cutout on the lower end is closed by the second soldering part.

11. The connector assembly according to claim 5, wherein there is a cutout on a lower end of the second shell, the lower end facing the second board, and the cutout on the lower end is closed by the second soldering part.

12. The connector assembly according to claim 6, wherein there is a cutout on a lower end of the second shell, the lower end facing the second board, and the cutout on the lower end is closed by the second soldering part.

13. The connector assembly according to claim 7, wherein there is a cutout on a lower end of the second shell, the lower end facing the second board, and the cutout on the lower end is closed by the second soldering part.

14. The connector assembly according to claim 8, wherein there is a cutout on a lower end of the second shell, the lower end facing the second board, and the cutout on the lower end is closed by the second soldering part.

15. The connector assembly according to claim 9, wherein there is a cutout on a lower end of the second shell, the lower end facing the second board, and the cutout on the lower end is closed by the second soldering part.

* * * * *